US007761988B2

(12) United States Patent
Rorig et al.

(10) Patent No.: US 7,761,988 B2
(45) Date of Patent: Jul. 27, 2010

(54) METHOD OF MAKING AN OUTER LEVER OF A SWITCHABLE FINGER LEVER

(75) Inventors: Bodo Rorig, Weisendorf (DE); Peter Spitzer, Emskirchen (DE)

(73) Assignee: Schaeffler KG, Herzogenaurach (DE)

( * ) Notice: Subject to any disclaimer, the term of this patent is extended or adjusted under 35 U.S.C. 154(b) by 894 days.

(21) Appl. No.: 10/563,850

(22) PCT Filed: Jun. 2, 2004

(86) PCT No.: PCT/EP2004/005922

§ 371 (c)(1),
(2), (4) Date: Dec. 14, 2006

(87) PCT Pub. No.: WO2005/005788

PCT Pub. Date: Jan. 20, 2005

(65) Prior Publication Data

US 2008/0189944 A1 Aug. 14, 2008

(30) Foreign Application Priority Data

Jul. 9, 2003 (DE) ..... 103 30 881

(51) Int. Cl.
*B21K 1/12* (2006.01)

(52) U.S. Cl. ..... 29/888.2; 29/890.132; 29/557

(58) Field of Classification Search ..... 29/557, 29/558, 890.126, 890.128, 890.132, 888.2
See application file for complete search history.

(56) References Cited

U.S. PATENT DOCUMENTS 4,430,783 A * 2/1984 Wherry ..... 29/888.2
4,624,223 A * 11/1986 Wherry et al. ..... 123/90.44
4,913,104 A 4/1990 Mills
4,944,257 A 7/1990 Mills
4,995,281 A * 2/1991 Allor et al. ..... 74/559
5,016,582 A * 5/1991 Mills ..... 123/90.39
5,259,346 A 11/1993 Mills
5,544,626 A * 8/1996 Diggs et al. ..... 123/90.16
5,655,490 A * 8/1997 Nagano et al. ..... 123/90.41
6,314,928 B1 11/2001 Baraszu et al.

FOREIGN PATENT DOCUMENTS

DE 27 53 197 A 6/1978
DE 39 29 486 C 3/1990
DE 196 18 417 A 11/1997
DE 196 31 653 A 2/1998
DE 198 16 020 A 10/1999
DE 199 50 990 A 8/2000
DE 199 30 573 A 1/2001

(Continued)

*Primary Examiner*—David P Bryant
*Assistant Examiner*—Jacob J Cigna
(74) *Attorney, Agent, or Firm*—Charles A. Muserlian

(57) ABSTRACT

According to the present invention, an outer lever (1) of a finger lever (2) that can be switched to different lifts for at least one gas exchange valve is made by a deep drawing method. A salient feature of the invention is that a cup-shaped base body (16) having an inverse U-shaped cross-section is deep drawn, and opposing running contact surfaces (14, 15) for high-lift cams are created on arms (4, 5) of the outer lever (1) by punching out a bottom (19) of the base body (16). Through the deep drawing method of the invention, only relatively low fabrication costs are to be expected.

10 Claims, 2 Drawing Sheets

FOREIGN PATENT DOCUMENTS

| | | | |
|---|---|---|---|
| DE | 100 30 341 | A | 1/2002 |
| DE | 100 59 545 | A | 6/2002 |
| EP | 0 573 674 | B | 12/1993 |
| EP | 0 849 436 | A | 6/1998 |
| GB | 2 020 389 | A | 11/1979 |
| WO | WO 2004/079164 | A | 9/2004 |

* cited by examiner

METHOD OF MAKING AN OUTER LEVER OF A SWITCHABLE FINGER LEVER

This application is a 371 of PCT/EP2004/005922 filed Jun. 2, 2004

FIELD OF THE INVENTION

The invention concerns a method of making an outer lever of a finger lever that can be switched to different lifts for at least one gas exchange valve, said outer lever comprising two substantially parallel arms whose ends are connected by crossbars so that a rectangular or O-like aperture for an inner lever that is capable of pivoting relative to the outer lever is formed, a running contact surface for a high-lift cam being arranged on an upper side of each arm.

BACKGROUND OF THE INVENTION

The use of switchable finger levers of the pre-cited type made after the lever-in-lever principle is constantly increasing because, while offering a variability of the valve train, they necessitate only relatively insignificant modifications to prior art cylinder heads and their surrounding structures. The basic principle of such finger levers is known, for instance, from DE-OS 27 63 197 and U.S. Pat. No. 5,544,626.

The outer levers of switchable finger levers are made in the prior art by casting or similar creative forming methods. Fabrication by a casting method is relatively complex and therefore also expensive. In addition, as a rule, a lever made by casting is relatively heavy and thus has a detrimental effect on the friction and the oscillating masses in the valve train.

OBJECTS OF THE INVENTION

It is an object of the invention to provide an economic method of making an outer lever for a switchable finger lever.

This and other objects and advantages of the invention will become obvious from the following detailed description.

SUMMARY OF THE INVENTION

The invention achieves the above objects by a method comprising the following steps:

a) deep drawing a cup-shaped base body out of a metal sheet or a sheet metal strip such that at least one drawing die is applied to the metal sheet or the sheet metal strip from an underside of the arms to be formed and a substantial height of the arms and the crossbars in the cup-shaped base body is produced, so that, as viewed in cross-section, an inverse U-shaped profile is formed, b) reducing a radius in an edge region between a bottom of the cup-shaped base body and outer sides of the arms by shaping, typically stamping or extrusion at least in a region of the running contact surfaces to be subsequently formed, and c) punching out the bottom of the cup-shaped base body except for at least the two opposing running contact surfaces.

An outer lever made by this method can be manufactured relatively economically. Particularly in mass production, and that is the focus here, a change-over from castings to deep drawn sheet metal results in an excellent reduction of costs.

It goes without saying that the cup-shaped base body can also be given its intended depth in several drawing steps. In the case of sheet metal strip, the entire final geometry can be created on a multi-step stamping and bending machine.

Through the stamping operation of step b) that is intended to serve only as an example, a sharp-edged transition is created from the upper sides of the arms to their outer sides, so that a width of the running contact surfaces is enlarged and the outer lever as a whole has a smaller design width. For the stamping operation, one die can be applied to an outer side of each arm and at least one die to an inner side of the arms and an underside of the bottom.

A coupling of the levers is intended to be realized through a coupling element such as a pin that can be displaced longitudinally out of the inner element on the side of one end and engages under an underside of the corresponding crossbar to achieve coupling. For the basic principle of longitudinal locking reference may be made, for instance, to U.S. Pat. No. 5,544,626. It goes without saying that this step can be omitted in the case of crosswise locking.

It is likewise clear that further method steps can also be added before, between and after those proposed by the invention. Moreover, a final geometry of the arms and crossbars may also be realized through the use of additional tools, preferably shaping tools, applied to their outer sides.

As soon as the bottom has been punched out in step c), the arms and the crossbars have their basic height and geometry. Possibly necessary finishing steps, however, will not be discussed further in the present context.

A particular advantage of the invention is that through the punching-out operation of the method step c), the running contact surfaces for the cams are created without additional measures. It is preferably intended to create running contact surfaces for high-lift cams. It is also conceivable and intended to provide a running contact surface only on one of the arms if only one lifting cam is to be applied to the outer lever.

According to further propositions of the invention, a cavity and a finger, which is bent upwards through approximately 90° after being punched out, serve to prevent an undesired outward motion of the aforesaid longitudinally displaceable coupling element in the inner element over a corresponding upper side of the crossbar when the outer lever is uncoupled from the inner lever (low or zero lift).

According to a further advantageous proposition of the invention, the bottom is punched out or cut off completely except for the running contact surfaces and, if appropriate, the extension or finger. In this way, upper sides of the outer lever merge directly, through a "smooth surface", into the respective inner surfaces of the arms and the crossbars. The mass of the outer lever is thus reduced.

Due to the cylindrical configuration of the running contact surfaces according to a further proposition of the invention, it is possible to reduce the length of these surfaces if desired or necessary. An excellent cam contact is likewise guaranteed through this configuration.

According to a further advantageous feature of the invention, the running contact surfaces extend approximately at the center of the arms. "Center" in the present context relates to the longitudinal dimension of the outer lever. If necessary, an off-center configuration, preferably further away from the point of pivot of the outer lever, is also conceivable.

Advantageously, a further step d) can follow the method step c). In this further step, it is proposed to make two aligned receptions for an axle for the pivotal mounting of the inner lever relative to the outer lever, by punching or boring or the like.

If desired or necessary, the crossbar not comprising the extension or finger for the coupling element can be omitted.

The invention will now be described more closely with reference to the appended drawing.

DETAILED DESCRIPTION OF THE DRAWING

Figure 1:
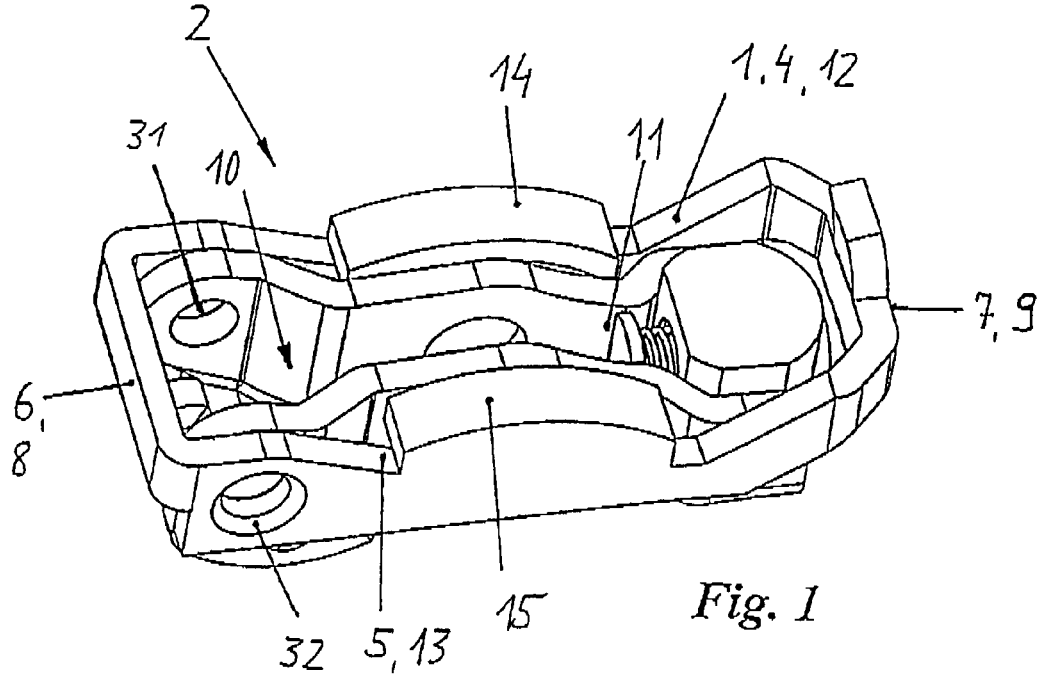
FIG. 1 is a perspective view of a finger lever comprising an outer lever and an inner lever.

The finger lever 2 (see FIG. 1) comprises an outer lever 1 which encloses in its aperture 10, an inner lever 11 that is capable of pivoting relative to the outer lever 1. The two levers 1, 11 are mounted on a common axle (not shown) in the region of one end 6.

The outer lever 1 comprises two substantially parallel arms 4, 5 that are connected through a crossbar 8, 9 at each of their ends, 7. Therefore, as seen in a top view, the outer lever 1 has a rectangular or O-like geometry. The upper side 12, 13 of each arm 4, 5 comprises a running contact surface 14, 15 for a cam although from the functional point of view, only one running contact surface 14 or 15 is necessary. On the side of the end 7, the inner lever 11 comprises a longitudinally displaceable slide, not shown, that can be pushed under an underside of the crossbar 9 or into the crossbar 9 of the outer lever 1 for coupling the levers 1, 11.

The method of the invention for making the outer lever 1 is described more closely in the following.

Figure 2:
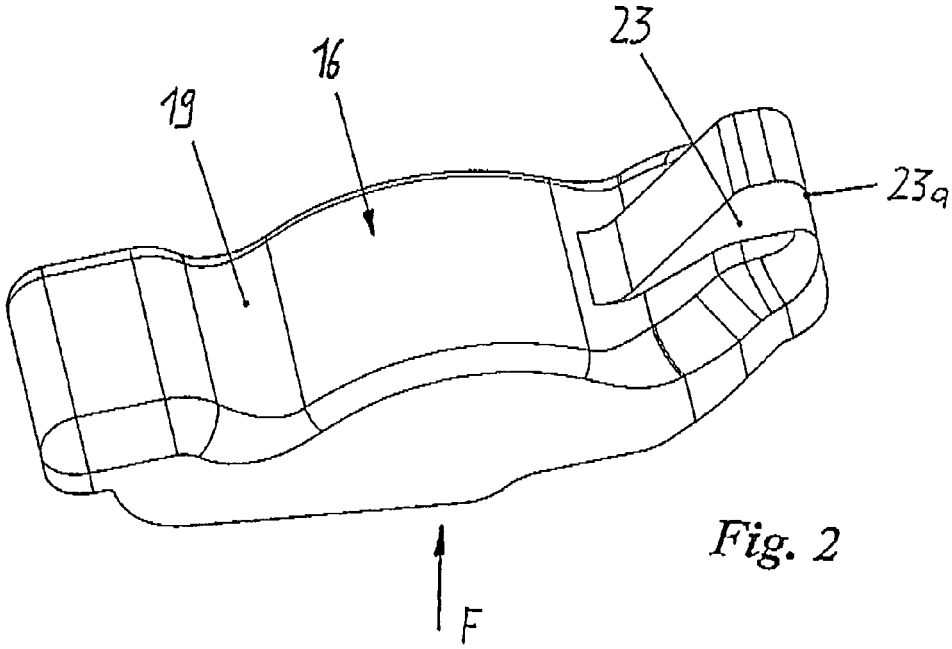
FIG. 2 is a view of the outer lever at one stage of its fabrication.

Starting from a metal sheet or a sheet metal strip, a cup-shaped body 16 having an inverse U-shaped cross-section is deep-drawn in a first step of the method (see FIG. 2). The arrow "F" in FIG. 2 identifies the direction of application of the at least one deep-drawing die (several drawing steps are also conceivable). During the drawing operation, the substantial height of the arms 4, 5 and the crossbars 8, 9 is generated in the base body 16.

Figure 3:
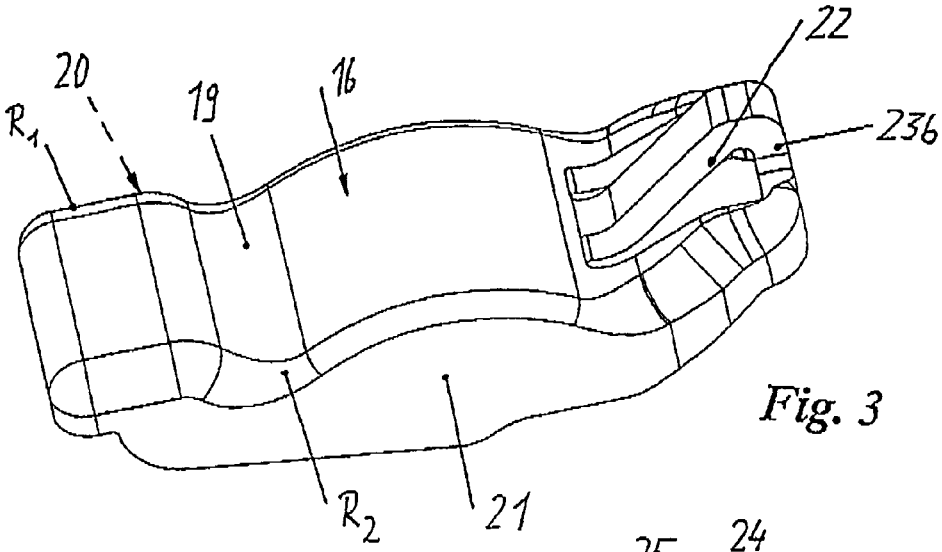
FIG. 3 is a view of the outer lever at another stage of its fabrication.

A laterally closed cavity 23 (s. FIG. 2) or an open cavity 22 (s. FIG. 3) is also configured on the end 7 preferably during the drawing of the bottom 19. Following this, stamping dies or the like familiar to the person skilled in the art are placed against the outer sides 20, 21 of the arms 4, 5, against the bottom 19 and in a recess 10 of the base body 16 to produce a drastic minimization of a radius $R_{1,2}$ in the edge region between the bottom 19 and the outer sides 20, 21. The bottom 19 is then punched out such that the upper sides 12, 13, except for the running contact surfaces 14, 15, merge through a relatively sharp edge into inner surfaces 25, 26 of the arms 4, 5, and an extension 23*a*, 23*b* projecting from the crossbar 9 remains at the cavity 23, 22. If necessary, the aforesaid stamping operation may also be carried out after the bottom 19 has been punched out.

Figure 4:
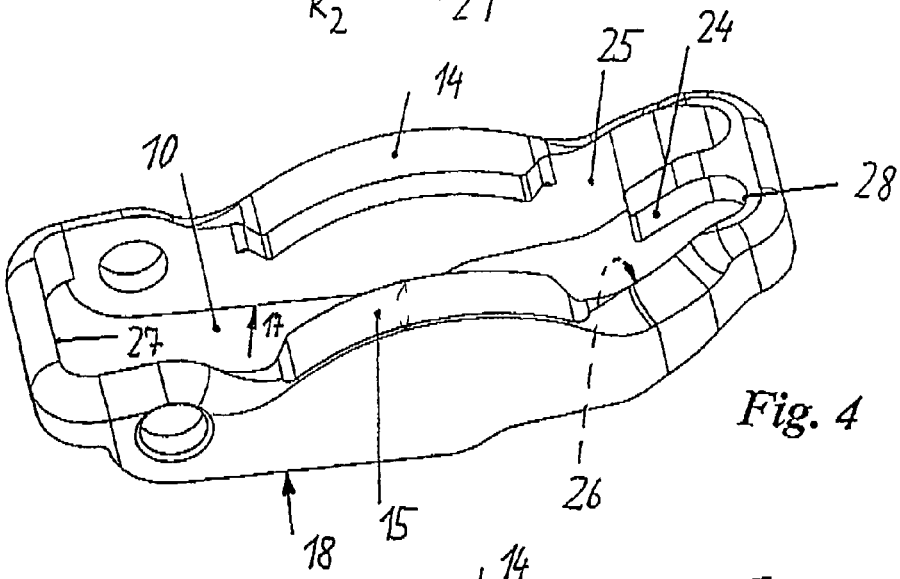
FIG. 4 is a view of the outer lever at still another stage of its fabrication.
Figure 5:
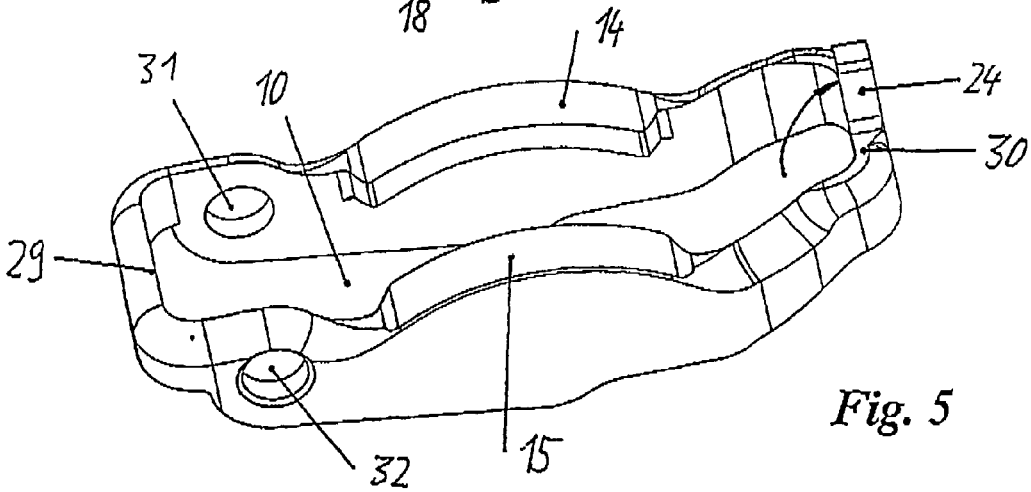
FIG. 5 is a view of the outer lever at still another stage of its fabrication.

Alternatively, the bottom 19 can be punched out in such a way that besides the running contact surfaces 14, 15, a finger 24 projecting from the crossbar 9 in a longitudinal direction of the lever is left over and then bent through 90°, in the present case in clockwise direction, into an upright position (s. FIGS. 4, 5).

A further method step can follow in which two aligned receptions 31, 32 are punched or bored into the arms 4, 5 in the vicinity of the crossbar 8. These receptions 31, 32 serve to receive an axle for mounting the inner lever 11 in the outer lever 1.

As can be clearly seen in FIGS. 2, 5, the running contact surfaces 14, 15 on the arms 4, 5 have a slightly cylindrical shape as viewed in longitudinal direction. This shape is advantageously produced without chip removal during the shaping operation of the outer lever 1.

The invention claimed is:

1. A method of making an outer lever of a finger lever that can be switched to different lifts for at least one gas exchange valve, said outer lever comprising two substantially parallel arms whose ends are connected by crossbars so that a rectangular or O-like aperture for an inner lever that is capable of pivoting relative to the outer lever is formed, a running contact surface for a high-lift cam being arranged on an upper side of each arm said method of comprising the following work steps to which further intermediate steps may be added:

a) deep drawing a cup-shaped base body our of a metal sheet or a sheet metal strip such that at least one drawing die is applied to the metal sheet or the sheet metal strip from an underside of the arms to be formed and a substantial height of the arms and the crossbars in the cup-shaped base body is produced, so that, as viewed in cross-section, an inverse U-shaped profile is formed, b) reducing a radius in the edge region between a bottom of the cup-shaped base body and outer sides of the arms by shaping, typically stamping or extrusion at least in the region of the running contact surfaces to be subsequently formed, and c) punching out the bottom of the cup-shaped base body except for at least the two opposing running contact surfaces, and wherein simultaneously with, or directly or indirectly after step a), a further step is carried out in which the drawing die or at least one further drawing die or a stamping die is applied to the bottom in deep drawing direction in a vicinity of the end, so that, one of a laterally open or closed lug-like cavity is formed, and the material of the cavity is also punched out in step c) except for an extension starting from the crossbar said one of the end, and wherein a finger pointing in a longitudinal direction of the lever is punched out of the bottom simultaneously with the running contact surfaces, which finger is bent away from the aperture in a consequent step so as to project upwards from the crossbar.

2. A method of claim 1 wherein the cavity extends from a center crossbar.

3. A method of claim 1, wherein the bottom is cut off in step c) such that inner surfaces of the arms and the crossbars, except for the running contact surfaces, merge directly or at least approximately directly into the upper sides.

4. A method of claim 1, wherein the running contact surfaces made in step c) have a beam-like geometry and possess, as viewed in longitudinal direction, a slightly cylindrical shape.

5. A method of claim 1 wherein the running contact surfaces made in step c) extend approximately at a center of the arms.

6. A method of claim 1 wherein step c) is followed by a further step d) in which two aligned receptions are one of punched or bored into the arms in the vicinity of the crossbar that is opposed to the crossbar comprising the cavity, and said receptions serve to receive an axle for the pivoted mounting of the inner lever relative to the outer lever.

7. A method of claim 1, wherein the running contact surface of each arm of the outer lever is intended for a contact with a high-lift cam.

8. A method of claim 1, wherein the finger extends from a center of the crossbar.

9. A method of claim 8, wherein the running contact surfaces made in step c) extend approximately at a center of the arms.

10. A method of claim 1, wherein step c) is followed by a further step d) in which two aligned receptions are one of punched or bored into the arms in a vicinity of the crossbar that is opposed to the crossbar comprising the finger, and said receptions serve to receive an axle for a pivoted mounting of the inner lever relative to the outer lever.

* * * * *